US011786954B2

(12) United States Patent
Willerscheid et al.

(10) Patent No.: US 11,786,954 B2
(45) Date of Patent: Oct. 17, 2023

(54) METHOD AND DEVICE FOR EXPANDING A METAL ELEMENT

(71) Applicant: PROTEKTORWERK FLORENZ MAISCH GMBH & CO. KG, Gaggenau (DE)

(72) Inventors: Heiner Willerscheid, Lauf (DE); Andreas Weinmann, Gaggenau (DE)

(73) Assignee: PROTEKTORWERK FLORENZ MAISCH GMBH & CO. KG, Gaggenau (DE)

( * ) Notice: Subject to any disclaimer, the term of this patent is extended or adjusted under 35 U.S.C. 154(b) by 123 days.

(21) Appl. No.: 16/474,628

(22) PCT Filed: Dec. 13, 2017

(86) PCT No.: PCT/EP2017/082679
§ 371 (c)(1),
(2) Date: Jun. 28, 2019

(87) PCT Pub. No.: WO2018/134003
PCT Pub. Date: Jul. 26, 2018

(65) Prior Publication Data

US 2019/0337039 A1 Nov. 7, 2019

(30) Foreign Application Priority Data

Jan. 18, 2017 (DE) ..... 10 2017 100 920.5

(51) Int. Cl.
*B21D 47/02* (2006.01)
*B21D 31/04* (2006.01)
(Continued)

(52) U.S. Cl.
CPC ..... *B21D 31/04* (2013.01); *B21D 47/02* (2013.01); *E04C 2/08* (2013.01); *E04C 2/328* (2013.01); *E04C 3/09* (2013.01)

(58) Field of Classification Search
CPC ..... B21D 31/04; B21D 47/02; E04C 2/08; E04C 2/328; E04C 3/09; E04D 15/02
See application file for complete search history.

(56) References Cited

U.S. PATENT DOCUMENTS 2,329,789 A * 9/1943 Schank ..... B21D 53/04 428/595
5,081,814 A 1/1992 Singletary et al.
(Continued)

FOREIGN PATENT DOCUMENTS

DE 102 59 307 A1 7/2004
DE 10 2006 010 795 A1 9/2007
DE 10 2011 108 679 A1 1/2013

OTHER PUBLICATIONS

International Search Report dated Apr. 13, 2018 in corresponding International Application No. PCT/EP2017/082679, filed Dec. 13, 2017 (with English Translation).
(Continued)

*Primary Examiner* — Nirvana Deonauth
(74) *Attorney, Agent, or Firm* — GLOBAL IP COUNSELORS, LLP

(57) ABSTRACT

A method of expanding an elongated and at least regionally planar metal element that has two respective marginal regions oppositely disposed and extending in a longitudinal direction and a central region arranged therebetween and including cuts, the marginal regions of the metal element are moved apart transversely to the longitudinal direction and in parallel with a planar extent of the metal element such that connection portions of the central region formed by the cuts and connecting the two respective marginal regions to one another are folded, the method includes displacing the two respective marginal regions with respect to one another transversely to the planar extent of the metal element to form
(Continued)

a displaced state, and subsequently moving apart the two respective marginal regions in the displaced state.

19 Claims, 12 Drawing Sheets

(51) Int. Cl.

| | |
|---|---|
| ***E04C 2/08*** | (2006.01) |
| ***E04C 2/32*** | (2006.01) |
| ***E04C 3/09*** | (2006.01) |

(56) References Cited

U.S. PATENT DOCUMENTS

| | | | | |
|---|---|---|---|---|
| 7,820,302 | B2 * | 10/2010 | Krettenauer | E04C 2/427 428/595 |
| 8,276,249 | B2 * | 10/2012 | Willerscheid | B21D 31/04 29/6.1 |
| 2006/0246312 | A1 | 11/2006 | Krettenauer | |
| 2010/0000284 | A1 | 1/2010 | Willerscheid et al. | |

OTHER PUBLICATIONS

German Search Report dated Sep. 20, 2017 in corresponding German Patent Application No. 10 2017 100 920.5 (with English Translation of Categories of Cited Documents).

Untied Arab Emirates Search Report dated Sep. 21, 2022 in corresponding Untied Arab Emirates Application No. P6001014/2019.

* cited by examiner

METHOD AND DEVICE FOR EXPANDING A METAL ELEMENT

CROSS-REFERENCE TO RELATED APPLICATION

This application is a U.S. National Stage application of International Application No. PCT/EP2017/082679, filed Dec. 13, 2017, which claims priority to German Patent Application No. 10 2017 100 920.5, filed Jan. 18, 2017, the contents of each of which are hereby incorporated herein by reference.

BACKGROUND

Field of the Invention

The present invention relates to a method of expanding an elongated and at least regionally planar metal element that has two respective marginal regions that are oppositely disposed and that extend in the longitudinal direction and a central region that is arranged therebetween and that includes cuts, wherein the marginal regions of the metal element are moved apart transversely to the longitudinal direction and in parallel with the planar extent of the metal element such that connection portions of the central region formed by the cuts and connecting the marginal regions to one another are folded.

Background Information

Planar metal elements such as are described in DE 102 59 307 A1 should in particular be expanded using the method in accordance with the invention and using the apparatus in accordance with the invention.

Elongated and at least regionally planar metal elements are used, for example, for manufacturing section elements for the construction industry, in particular upright sections or plaster sections. A widening of the metal element with an unchanging material amount results due to the folding over or folding of the connection portions. Wider metal elements can thus be manufactured by the folding with a reduced material consumption and a reduced weight. A special advantage of the folding process comprises no complex and/or expensive stamping being required for the production of the corresponding cut-outs and in particular no material waste being incurred.

The cutting patterns required for the folding process can be of the most varied type. A plurality of such cutting patterns are described and shown in said DE 102 59 307 A1. For the better understanding of the present application, the disclosure content of DE 102 59 307 A1, in particular with respect to the specifically described and shown cutting patterns, is explicitly included in the content of the present application.

SUMMARY

The metal elements in the sense of the present invention are made planar at least in the region of the cutting patterns. In other regions, for example also in the region of the longitudinal sides of the metal elements, the metal elements can also deviate from the planar shape. Thickened regions, steps or bent over regions can in particular be formed at the longitudinal sides. The metal elements can thus e.g. already be preshaped as U-shaped sections or C-shaped sections. The metal elements can furthermore be produced from roll material that is bent in different manners during manufacture. The term "planar extent of the metal element" is accordingly meant to be the plane of the local extent at the point at which the pulling apart and folding take place. It must additionally be pointed out that parts of the central portion are generally also moved on the moving apart of the marginal regions.

The pulling apart of the marginal regions preferably takes place automatically in a continuous process such as is described in DE 10 2006 010 795 A1. Here, the marginal regions are gripped by a suitable clamping holding apparatus and are pulled apart in opposite directions. Although this method has proved itself in practice, there is a desire for a reduction in the force to be applied for pulling apart and for more exactly defined folding edges. A particular challenge here comprises the fact that section elements of the initially named kind represent a mass-produced article that is produced at a very high speed, for example 100 to 150 m/min, and that is subject to high cost pressure.

It is an object of the invention to make possible a simpler and more reliable expansion of elongated, at least regionally planar metal elements.

The invention provides that the marginal regions are displaced with respect to one another transversely to the planar extent of the metal element after the generation of the cuts in the central region in a first method step before moving apart and are moved apart in the displaced state in a subsequent second method step. In other words, the marginal regions and, optionally, also parts of the central region are moved at least locally in two planes displaced in parallel with one another. The connection portions to be folded that are each directly or indirectly connected to both marginal regions are drawn upward here, that is after the displacement they extend obliquely from one of the two parallel planes to the other. This is advantageous to the extent that a favorable lever effect results on the subsequent moving apart of the marginal regions so that the force required for folding is reduced. In addition, the kink points or fold points are already formed exactly at the points intended for them in the displacement process so that inexact kinks or defective kinks are reliably avoided. Due to the advantages achieved by the transverse displacement prior to the folding, it is possible to expand thicker and stiffer metal parts than was previously possible in an economic manner.

A pressing tool or rolling tool whose pressing surface has a step defining the displacement can be pressed onto the metal element to displace the marginal regions. The step can be formed as a unilateral flank between two substantially smooth portions of the pressing surface that at least locally define two planes displaced in parallel with one another. The use of a corresponding pressing tool or rolling tool enables a particularly simple and fast carrying out of the displacement process.

The step is preferably in the region of the central portion on the pressing of the pressing tool or rolling tool onto the metal element so that the marginal regions are accordingly pressed into the two planes displaced in parallel with one another.

An embodiment of the invention provides that the metal element is led through two rotatable rollers whose jacket surfaces have respective peripheral steps having oppositely aligned flanks. It is possible in this manner to carry out the displacement of the marginal regions in a continuous flow.

The rollers can be rotated in opposite directions on the leading through of the metal elements and can in particular be driven in opposite directions.

The marginal regions are preferably displaced with respect to one another by a shape corrected displacement that corresponds to at least three times, and at most 7 times, the thickness of the metal element. Such a displacement has been found to be particularly favorable in practice.

In accordance with a special embodiment of the invention, an embossed pattern is embossed in the central portion before or during the displacement of the marginal regions. Such an embossed pattern effects a stiffening of the expanded metal elements and accordingly an increase in stability in the produced section element. The embossed pattern can in particular comprise reinforcement beads that define recesses. The cuts of the central regions are preferably fully arranged in the recesses of the embossed pattern.

The metal element is preferably moved in the longitudinal direction during the displacement of the marginal regions and/or during the moving apart of the marginal regions so that the carrying out of the corresponding method steps takes place in a continuous flow.

The invention also relates to an apparatus for expanding an elongated and at least regionally planar metal element that has two respective marginal regions that are oppositely disposed and that extend in the longitudinal direction and a central region that is arranged therebetween and that includes cuts, in particular to an apparatus for carrying out a method such as described above, having a stretching unit that is configured to hold the marginal regions of the metal element and to move them apart transversely to the longitudinal direction and in parallel with the planar extent of the metal element so that connection portions of the central region connecting the marginal regions to one another are folded.

In accordance with the invention, the apparatus comprises a shape correction unit that is connected upstream of the stretching unit and that is configured to displace the marginal regions with respect to one another transversely to the planar extent. As described above, a favorable lever effect for the following step of pulling the marginal regions apart results from the transverse displacement of the marginal regions by the shape correction unit. In addition, the shape correction unit provides an avoidance of inexact kinks or defective kinks.

The shape correction unit can comprise a pressing tool or rolling tool whose pressing surface has a step defining the displacement. This allows a particularly simple construction.

The pressing surface can have at least substantially smooth outer portions that are arranged at both sides of the step, that are associated with the marginal regions of the metal element, and that extend, at least viewed locally, in two planes displaced with respect to one another. The step here forms one or more flanks extending between the planes.

The pressing tool or rolling tool preferably has at least one rotatable roller on whose jacket surface the step is peripherally formed. Such a shape correction unit can process roll material in a flow.

A special embodiment provides that the pressing tool or rolling tool comprises two rotatable rollers between which the metal element can be led, with the jacket surfaces of the rollers having respective peripheral steps having oppositely aligned flanks. The marginal regions and, optionally, parts of the central region are thus respectively clamped between the rollers and in so doing are fixed in a reliable manner in the oppositely displaced planes.

An embossed pattern that preferably extends beyond the step can be formed on the pressing surface. As described above, an embossed pattern has a stiffening effect. The embossed pattern can in particular comprise reinforcement beads that define recesses. The cuts of the central regions are preferably fully arranged in the recesses of the embossed pattern.

The apparatus can comprise a feed unit through which the metal element is movable in the longitudinal direction during the displacement of the marginal regions and/or during the moving apart of the marginal regions. The feed unit can in particular comprise a drive roller or an arrangement of a plurality of drive rollers.

The metal element can comprise galvanized steel, aluminum, or copper depending on the application.

The metal element can furthermore have a thickness of more than 0.5 mm, preferably of more than 0.6 mm. Such thick metal elements can at best be expanded with great difficulty using current methods and apparatus. Due to the reduction in force and the increase in reliability made possible by the displacement, thicker and stiffer metal elements can also be processed using an apparatus in accordance with the invention.

The stretching unit can have at least two clamping portions for a holding clamping of the marginal regions and an apparatus for the automatic moving apart of the clamping portions. This makes possible a simple and fast performance of the expansion process. The clamping portions can be designed such as is described in DE 10 2006 010 795 A1.

In accordance with a further embodiment of the invention, the apparatus comprises a pressing unit or rolling unit connected downstream of the stretching unit for flat pressing or flat rolling the expanded metal element. The fold points or kink points generated on the folding can be equalized in this manner.

An apparatus in accordance with the invention can comprise an embossing unit connected upstream of the shape correction unit to emboss an embossed pattern in the central portion.

Alternatively, the shape correction unit can have a combined embossing/displacement roller or roll by which both the marginal regions can be displaced transversely to the planar extent of the metal element and an embossed pattern can be embossed in the central portion. The displacement of the marginal regions and the generation of the embossed pattern can therefore be carried out in combination at a single work station. A separate embossing unit is then not required.

Further advantageous embodiments of the invention are set forth in the dependent claims, in the description and in the enclosed drawings.

BRIEF DESCRIPTION OF THE DRAWINGS

The invention will be explained in more detail hereinafter with reference to the drawings.

DETAILED DESCRIPTION OF THE EMBODIMENTS

Figure 1:
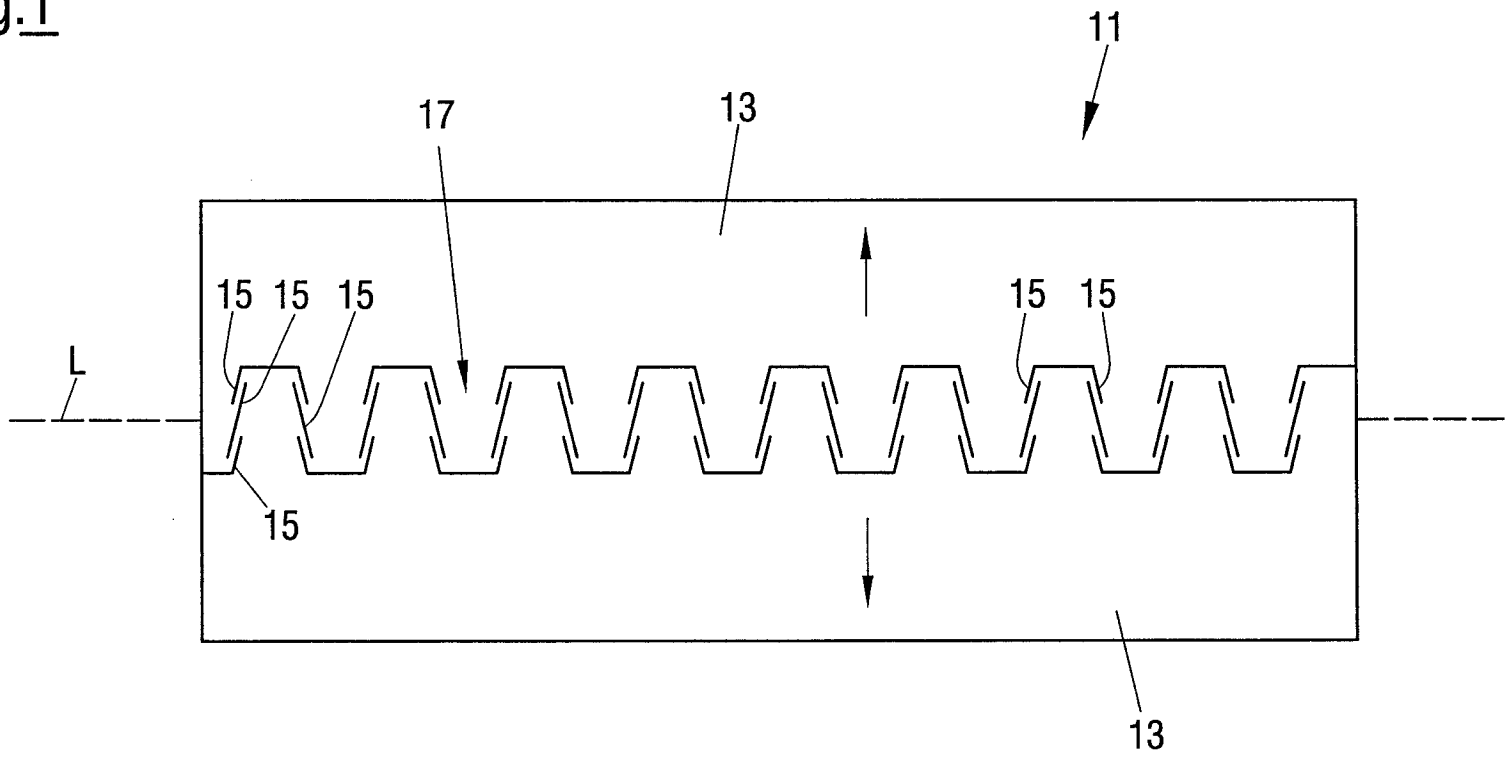
FIG. 1 shows a part of a planar metal element with a cutting pattern.

FIG. 1 shows a detail of a planar metal element 11 that has two oppositely disposed marginal regions 13 that extend along a longitudinal axis L and a central region 17 arranged therebetween and provided with cuts 15 engaging into one another. The marginal regions 13 are free of cuts, which is preferred, but not absolutely necessary. The detail shown in FIG. 1 is considerably shortened with respect to the actual length of the metal element 11. In actual fact, the metal element 11 forms a long metal strip which can have a length, for example, of several 100 m.

The metal element 11 is already described in DE 102 59 307 A1 to which reference is explicitly made.

The cuts 15 are arranged such that the marginal regions 13 of the metal element 11 can be pulled apart at right angles to the longitudinal axis L, as is indicated by arrows in FIG. 1. On the pulling apart of the marginal regions 13, connection portions 19 formed by the cuts 15 are folded in the form of narrow webs along kink lines 21 so that a resulting metal element 11 having an enlarged with is generated. A corresponding folding procedure is shown in detail in FIGS. 2 to 4.

Figure 7:
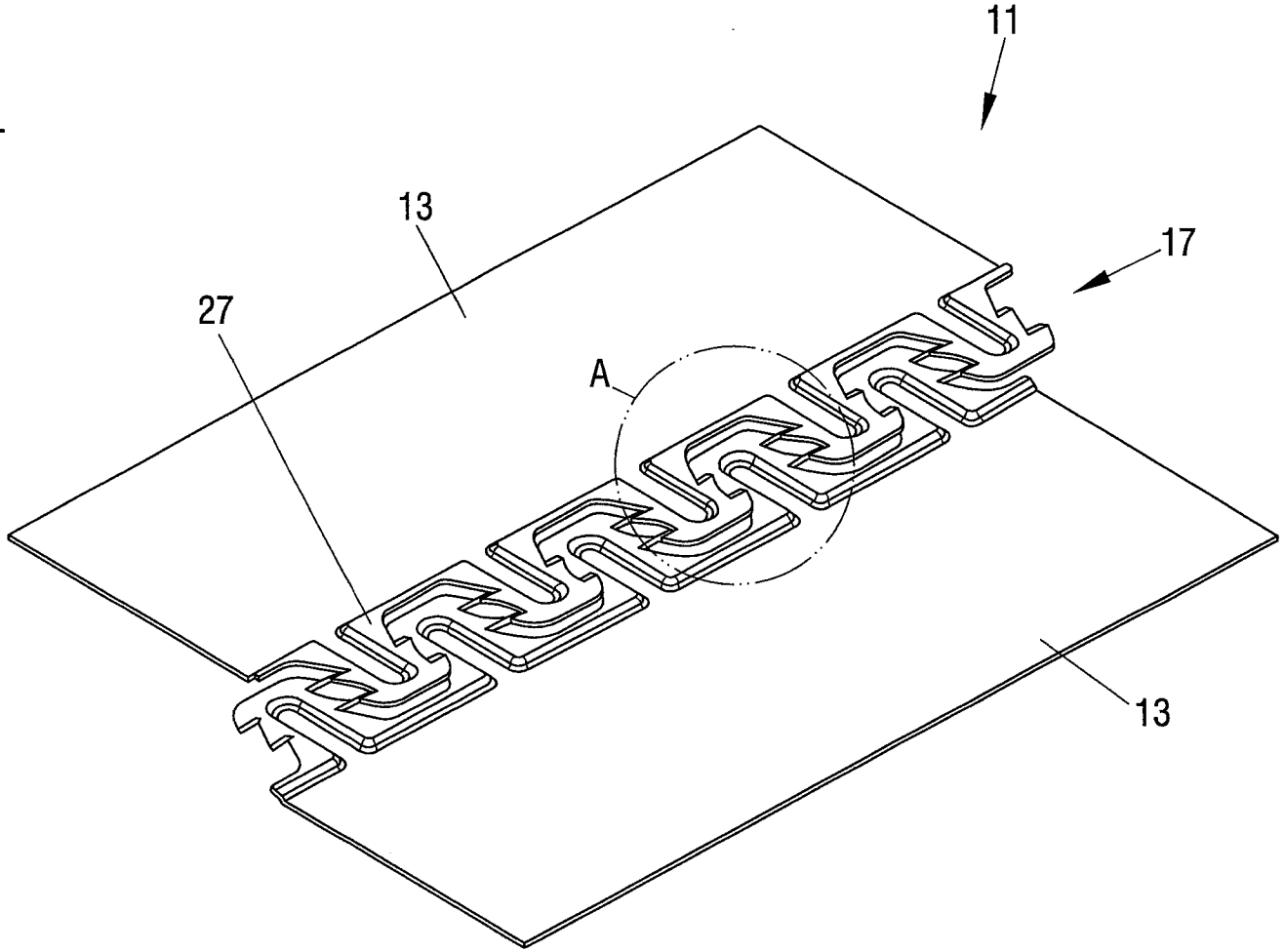
Figure 8:
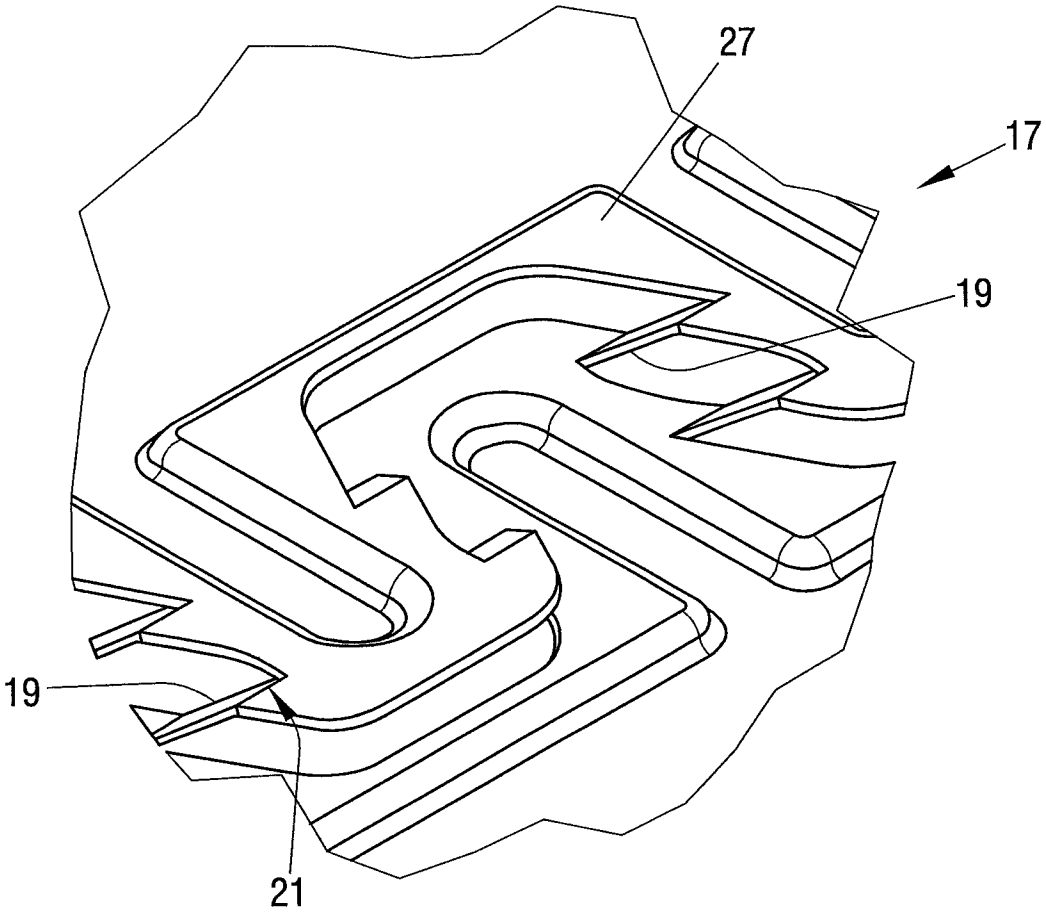
Figure 9:
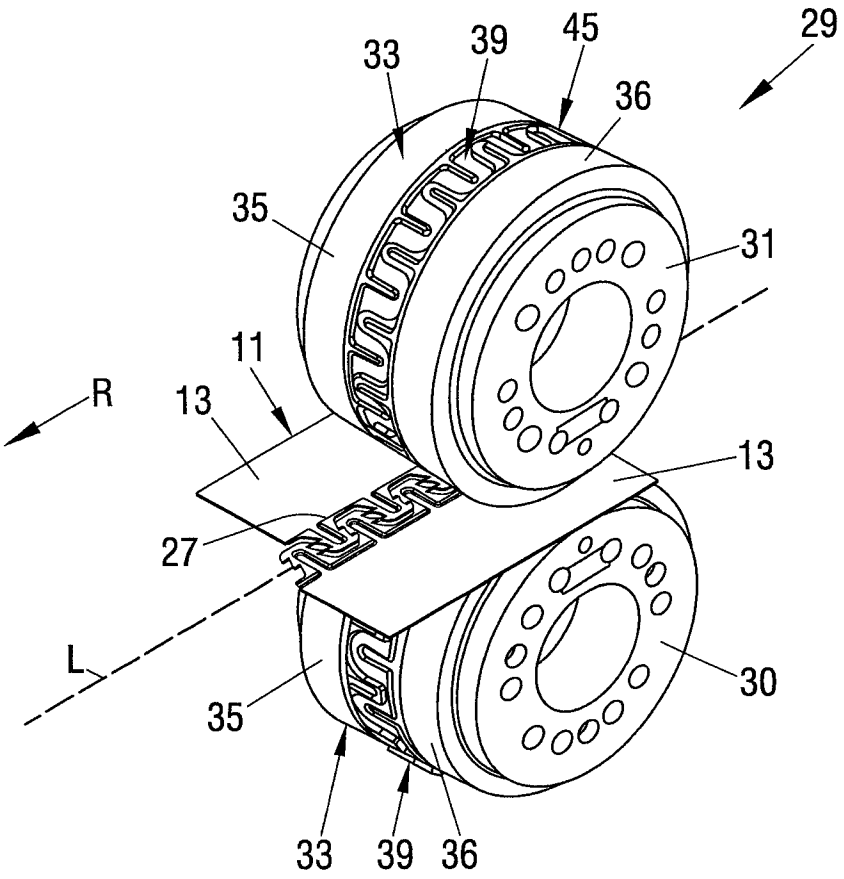
FIG. 9 is a perspective view of a shape correction unit of an apparatus in accordance with the invention for expanding a metal element.
Figure 10:
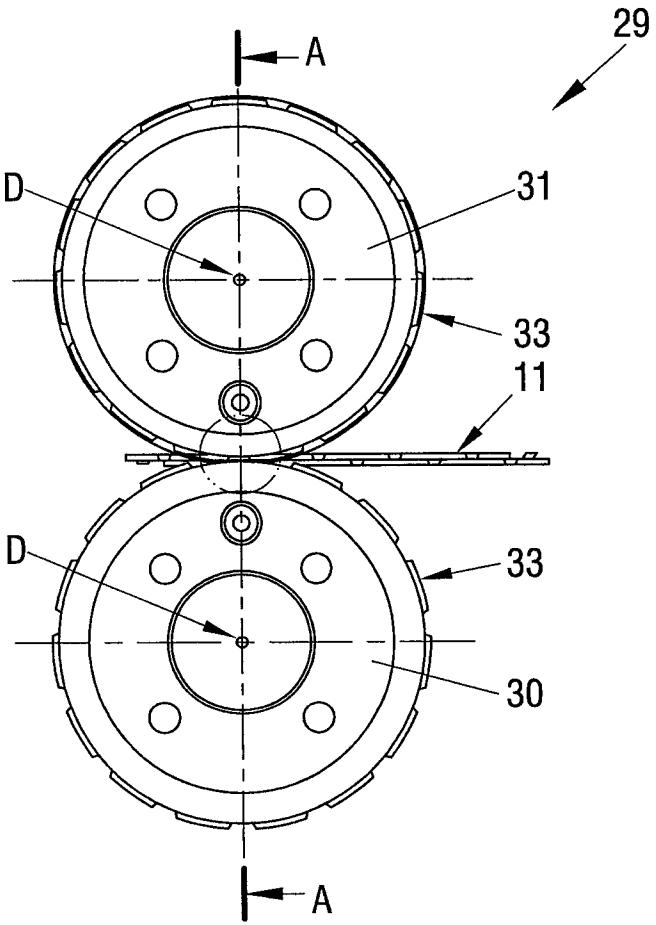
FIG. 10 is a side view of the shape correction unit in accordance with FIG. 9.
Figure 11:
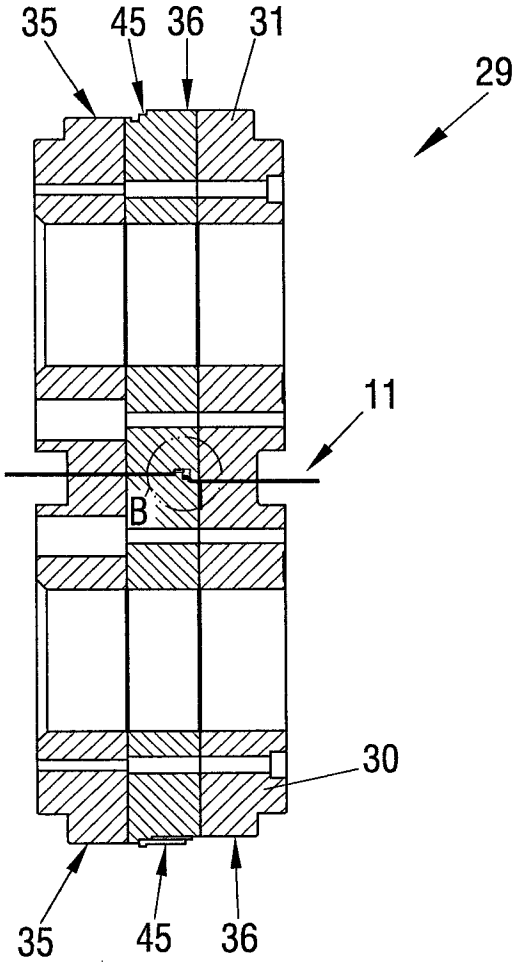
FIG. 11 shows a section along the line A-A in FIG. 10.
Figure 12:
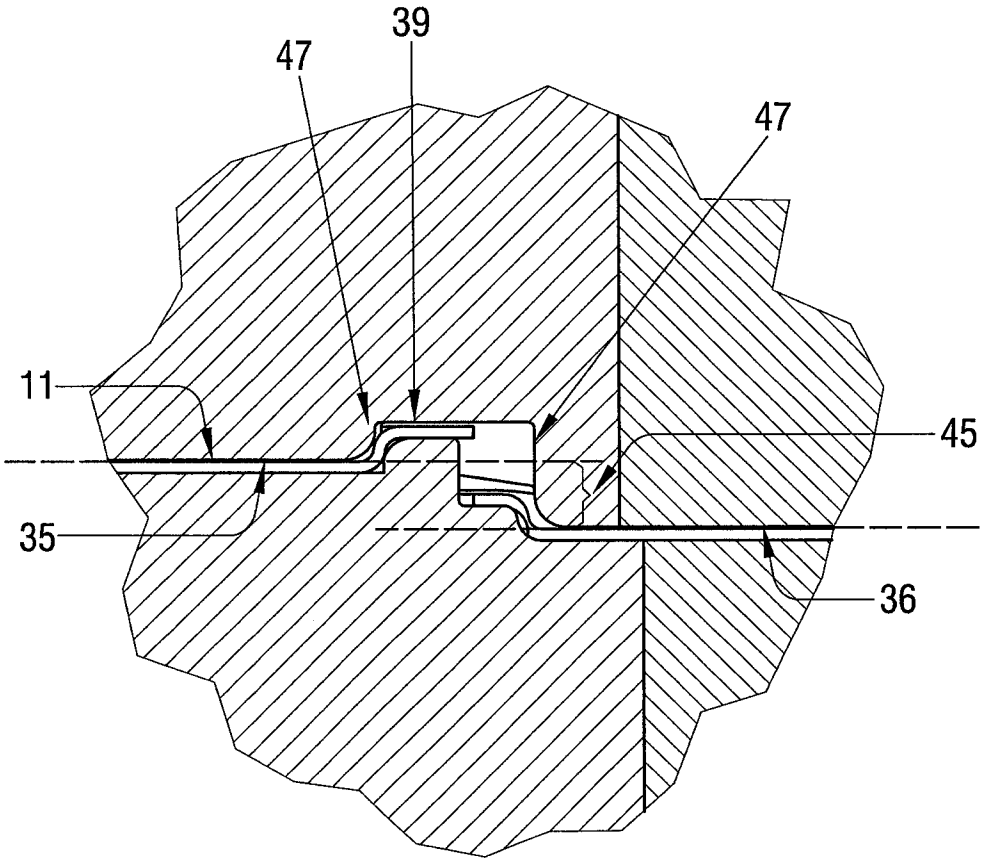
FIG. 12 is an enlarged representation of the detail B in FIG. 11.

Correspondingly expanded metal elements can be used, for example, for the manufacture of sections such as are used e.g. as edge protection or as upright sections for dry walls (FIG. 7), e.g. in the form of U-sections and C-sections.

Figure 2:
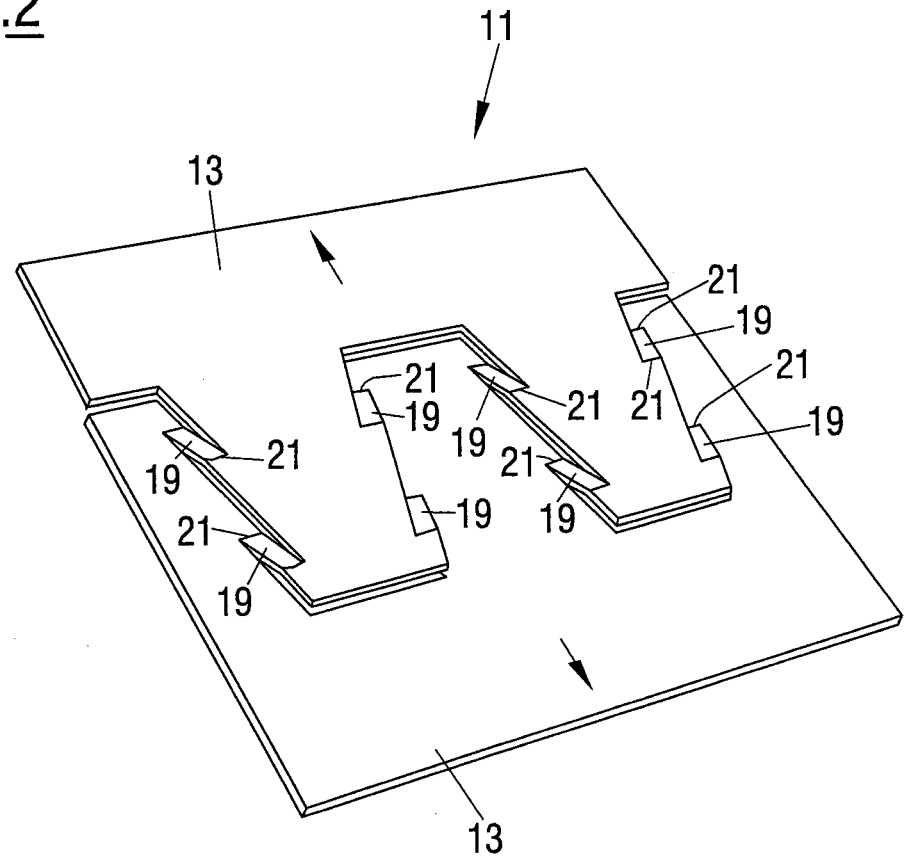
FIGS. 2 to 4 show three different states in the expansion of a metal element with the cutting pattern of FIG. 1.
Figure 3:
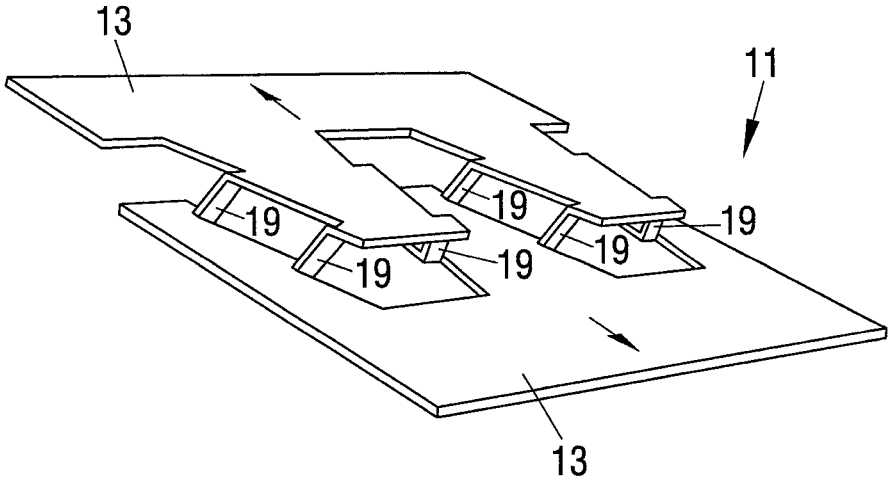
Figure 4:
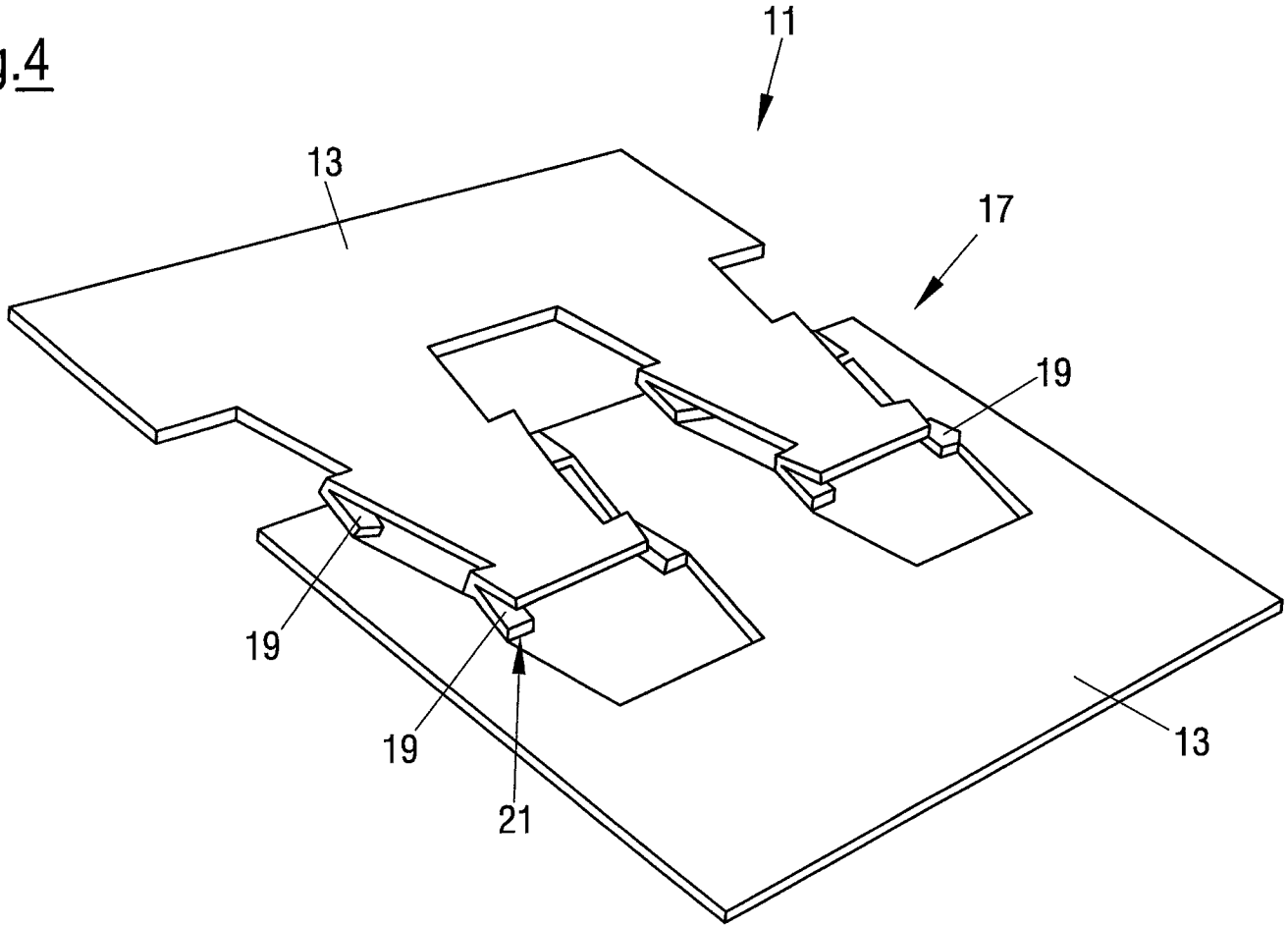
Figure 5:
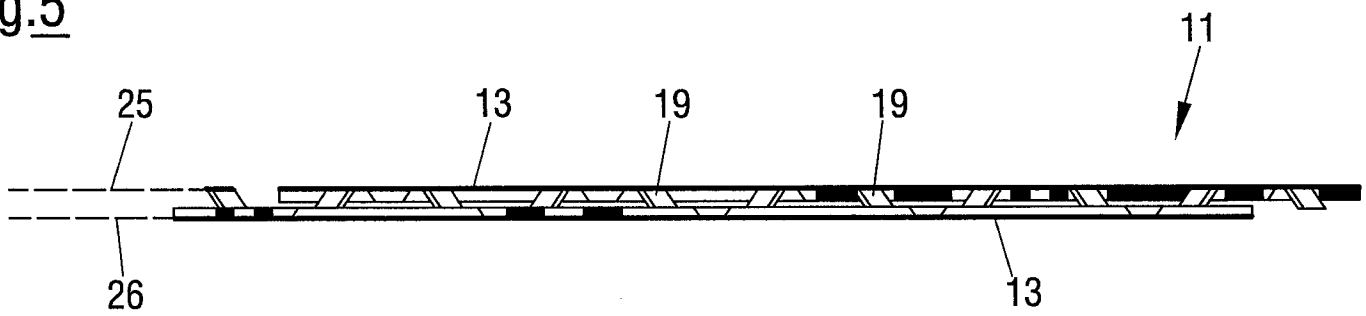
FIGS. 5 to 8 show a state of a metal element after the displacement of two marginal regions of the metal element transversely to its planar extent and before the expansion of the metal element.
Figure 6:
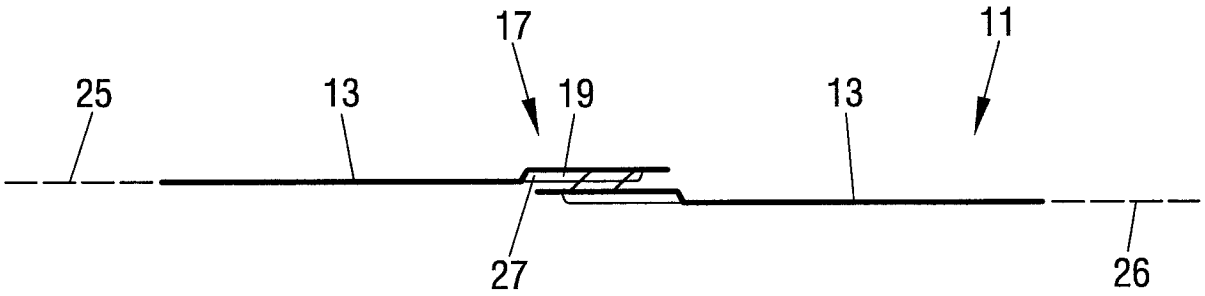

To be able to expand the metal elements 11 known per se at a high speed, as shown in FIGS. 2 to 4, an apparatus can, for example, be used such as is described in DE 10 2006 010 795 A1.

In a method in accordance with the invention of widening the metal element 11 shown in FIG. 1, the marginal regions 13 are not pulled apart at right angles to the longitudinal axis L, starting from the base state shown in FIG. 1, but are rather displaced with respect to one another beforehand in a preceding method step at right angles to the planar extent of the metal element 11. The displaced state is shown in FIGS. 5 to 8, with FIG. 5 being a side view transversely to the longitudinal axis L, FIG. 6 being a side view in the direction of the longitudinal axis L, FIG. 7 being a perspective view, and FIG. 8 being an enlarged representation of the region A in FIG. 7. It can be recognized that the two marginal regions 13 and parts of the central region 17 adjoining them extend in parallel planes 25, 26 that are spaced apart from one another, while the connection portions 19 are aligned obliquely to these planes 25, 26. An embossed pattern 27, whose generation will be described in even more detail in the following, is located in the central region 17.

The shape of the cuts 15 of the metal element 11 shown in FIGS. 5 to 8 differs slightly from the shape of the cuts 15 shown in FIGS. 1 to 4, which is, however, of no significance with respect to the displacement process.

Starting from the intermediate state shown in FIGS. 5 to 8, the marginal regions 13 are pulled apart in opposite directions, with the connection portions 19 being folded. Since the kink lines 21 are already formed in the intermediate state and since the connection portions 19 are slanted, the pulling apart can be carried out simply and with reduced pulling force. In addition no defective formation of kink lines 21 can occur. A method in accordance with the invention can therefore also be carried out for metal elements 11 having a thickness of more than 0.6 mm and for hard metal sorts.

With a conventional method for expanding a metal element 11, a displacement of the marginal regions 13 transversely to the planar extent of the metal element 11 likewise takes place since the connection portions 11 that fold over press the adjacent portions of the metal element 11 apart, as can be recognized in FIGS. 2 and 3. This is, however, an extremely brief transition state, particularly since it occurs inevitably due to the folding procedure. The invention in contrast provides that the marginal regions 13 are displaced in a direction facing transversely to the planar extent due to a targeted exertion of force and that the pulling apart of the marginal regions 13 only takes place after this targeted displacement step.

The displacement can be carried out using a shape correction unit (shape corrector) 29 shown in FIGS. 9 to 14. An apparatus in accordance with the invention for expanding a metal element 11 has, in addition to the shape correction unit 29, a stretching unit (stretcher) that is connected downstream of the shape correction unit 29, but that is not shown in FIGS. 9 to 14. The stretching unit serves to hold the marginal regions 13 of the metal element 11 and to pull them apart transversely to the longitudinal axis L and in parallel with the planar extent of the metal element 11. Specifically, the stretching unit can have clamping portions such as are disclosed in DE 10 2006 010 795 A1 engaging at the marginal regions 13.

An apparatus in accordance with the invention for expanding a metal element 11 can also comprise a pressing unit (presser) or rolling unit (roller) arranged downstream of the stretching unit for flat pressing or flat rolling the expanded metal element 11 and/or a feed unit for moving the metal element 11 along its longitudinal axis L in a feed direction R, which is likewise not shown in FIGS. 9 to 14. An apparatus in accordance with the invention for expanding a metal element 11 can furthermore comprise an embossing unit, not shown, connected upstream of the shape correction unit 29 for generating the embossed pattern 27.

The shape correction unit 29 comprises two rotatable pressing rolls 30, 31 between which the metal element 11 is led. The pressing rolls 31, 31 are rotated in opposite directions during the leading through, either passively or by a drive.

The pressing rolls 30, 31 are preferably produced from steel and have respective pressing surfaces 33 that have two smooth outer portions 35, 36 and an embossed portion 39 arranged therebetween. The embossed portions 39 of the two pressing rolls 30, 31 are shaped in a complementary manner and are aligned matching each other so that the embossed pattern 27 is not impaired by the pressing rolls 30 31 on the leading through of the metal element 11.

Figure 13:
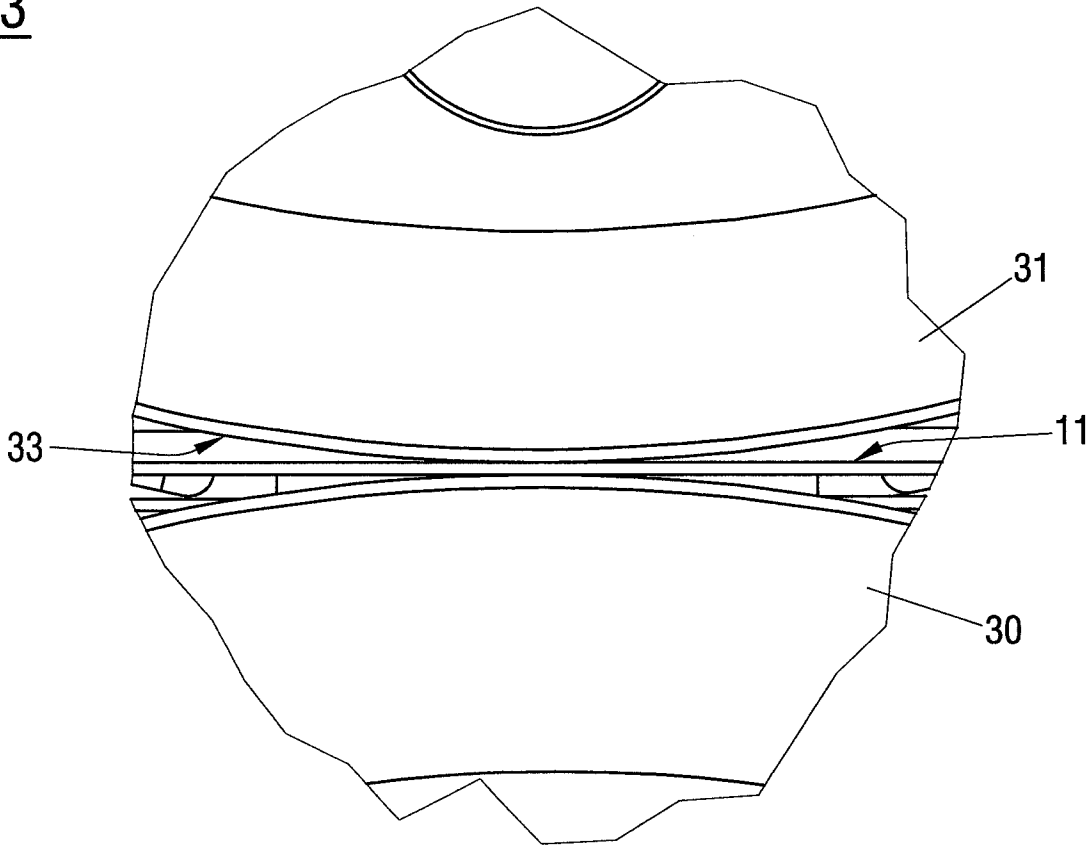
FIG. 13 is an enlarged representation of the detail C in FIG. 10.

The smooth outer portions 35, 36 of a pressing surface 33 furthermore extend at different spacings from the axis of rotation D (FIG. 10) so that they are radially displaced. A respective step 45 is therefore formed between the smooth outer portions 35, 36 and is arranged fully peripherally on the pressing surface 33. As can in particular be seen from FIG. 12, the step 45 in the embodiment shown is superposed by the embossed portion 39 and accordingly has a plurality of flanks 47. Instead of the embossed portion 39, however, a further smooth portion could also be provided, with the step 45 then preferably being formed as a single unilateral flank. It is understood that the steps 45 of the two pressing rolls 30, 31 are formed in a complementary manner so that on the leading of the metal element 11 through the pressing rolls 30, 31, the oppositely disposed marginal regions 13 are moved apart as desired transversely to the planar extent. The displacement defined by the steps 45 in the shape correction unit 29 amounts to 5 times the thickness of the metal element 11, which has proved favorable in practice. In the shape correction unit 29 described by way of example, the pressing rolls 30, 31 are spaced apart from one another such that the metal element 11 per se is not pressed or is not pressed by an appreciable amount (FIG. 13).

Figure 14:
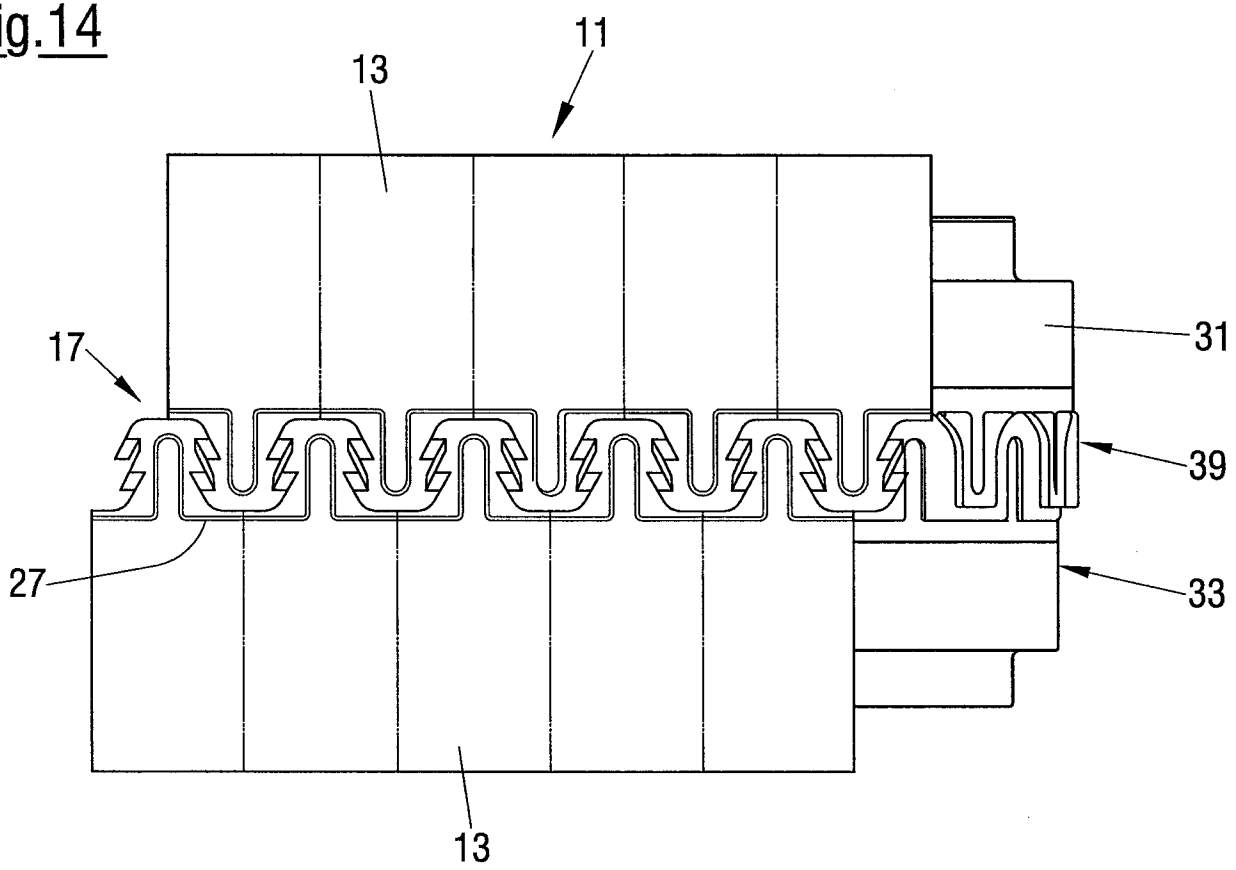
FIG. 14 is a plan view of a pressing roll of the shape correction unit in accordance with FIG. 9 including a metal element acted on by the pressing roll.

The deformation of the metal element 11 by the pressing surface 33 of a pressing roll 31 can be recognized in FIG. 14.

It is generally possible to carry out the generation of the embossed pattern 27, on the one hand, and the displacement of the marginal regions 13, on the other hand, not as described in different work stations as described above, but rather in a single work station. Such a work station can have a combined embossing/displacement roll or roller that due to its shape effects the displacement of the two marginal regions 13 and the forming of the stiffening embossed pattern 27 in one and the same workstep.

The invention makes possible a folding of the connection portions 19 with a reduced force effort and with exactly defined fold edges, whereby the expansion of metal elements 11 is significantly simplified.

The invention claimed is:

1. A method of expanding an elongated and at least regionally planar metal element that has two respective marginal regions oppositely disposed and extending in a longitudinal direction and a central region arranged therebetween and including cuts, the marginal regions of the metal element are moved apart transversely to the longitudinal direction and in parallel with a planar extent of the metal element such that connection portions of the central region formed by the cuts and connecting the two respective marginal regions to one another are folded, the method comprising:

displacing the two respective marginal regions with respect to one another transversely to the planar extent of the metal element to form a displaced state; and subsequently moving apart the two respective marginal regions in the displaced state, a pressing tool or a rolling tool having a pressing surface having a step defining the displacing being pressed onto the metal element to displace the two respective marginal regions.

2. The method in accordance with claim 1, wherein the step is located in the region of the central region during the pressing of the pressing tool or the rolling tool onto the metal element.

3. The method in accordance with claim 1, wherein the metal element is led between two rotatable rollers having jacket surfaces with respective steps having oppositely aligned flanks.

4. The method in accordance with claim 3, wherein the two rotatable rollers are rotated in opposite directions when leading the metal element through the two rotatable rollers.

5. A method of expanding an elongated and at least regionally planar metal element that has two respective marginal regions oppositely disposed and extending in a longitudinal direction and a central region arranged therebetween and including cuts, the marginal regions of the metal element are moved apart transversely to the longitudinal direction and in parallel with a planar extent of the metal element such that connection portions of the central region formed by the cuts and connecting the two respective marginal regions to one another are folded, the method comprising:

applying a force transverse to the planar extent of the metal element to displace the two respective marginal regions with respect to one another transversely to the planar extent of the metal element to form a displaced state; and subsequently moving apart the two respective marginal regions in the displaced state, the two respective marginal regions displaced with respect to one another by a shape corrected displacement that corresponds to at least three times a thickness of the metal element.

6. A method of expanding an elongated and at least regionally planar metal element that has two respective marginal regions oppositely disposed and extending in a longitudinal direction and a central region arranged therebetween and including cuts, the marginal regions of the metal element are moved apart transversely to the longitudinal direction and in parallel with a planar extent of the metal element such that connection portions of the central region formed by the cuts and connecting the two respective marginal regions to one another are folded, the method comprising:

applying a force transverse to the planar extent of the metal element to displace the two respective marginal regions with respect to one another transversely to the planar extent of the metal element to form a displaced state; and subsequently moving apart the two respective marginal regions in the displaced state, an embossed pattern embossed in the central region before or during the displacing of the two respective marginal regions.

7. An apparatus for expanding an elongated and at least regionally planar metal element, the metal element having two respective marginal regions oppositely disposed and extending in a longitudinal direction and a central region arranged therebetween and including cuts, the apparatus comprising:

a stretcher configured to hold the two respective marginal regions of the metal element and to move the two respective marginal regions apart transversely to the longitudinal direction and in parallel with a planar extent of the metal element such that connection portions of the central region formed by the cuts and connecting the marginal regions to one another are folded;

a shape corrector connected upstream of the stretcher and configured to displace the two respective marginal regions with respect to one another transversely to the planar extent of the metal element.

8. The apparatus in accordance with claim 7, wherein the shape corrector comprises a pressing tool or a rolling tool having a pressing surface with a step defining the displacement of the two respective marginal regions.

9. The apparatus in accordance with claim 8, wherein the pressing surface has two substantially smooth outer portions at first and second sides of the step and that are associated with the two respective marginal regions of the metal element.

10. The apparatus in accordance with claim 8, wherein the pressing tool or the rolling tool has at least one rotatable roller having a jacket surface with the step peripherally formed thereon.

11. The apparatus in accordance with claim 10, wherein the least one rotatable roller includes two rotatable rollers between which the metal element is configured to be led, with the steps of the jacket surfaces of the two rotatable rollers having oppositely aligned flanks.

12. The apparatus in accordance with claim 8, wherein an embossed pattern is formed on the pressing surface.

13. The apparatus in accordance with claim 7, further comprising a feeder through which the metal element is movable in the longitudinal direction during at least one of displacement of the two respective marginal regions or the moving apart of the two respective marginal regions.

14. The apparatus in accordance with claim 7, wherein the metal element comprises galvanized steel, aluminum, or copper.

15. The apparatus in accordance with claim 7, wherein the metal element has a thickness of more than 0.5 mm.

16. The apparatus in accordance with claim 7, wherein the stretcher has at least two clamping portions configured to hold and clamp the two respective marginal regions and an apparatus configured to automatically move apart the clamping portions.

17. The apparatus in accordance with claim 7, wherein the apparatus comprises a presser or roller connected downstream of the stretcher configured to flat press or flat roll the metal element when expanded.

18. The apparatus in accordance with claim 7, wherein the apparatus comprises an embosser connected upstream of the shape corrector configured to emboss an embossed pattern in the central portion.

19. The apparatus in accordance with claim 7, wherein the shape corrector has a combined embossing/displacement roller or roll by which both the two respective marginal regions are capable of being displaced transversely to the planar extent of the metal element and an embossed pattern is capable of being embossed in the central portion.

* * * * *